US010517341B2

(12) United States Patent
Swan et al.

(10) Patent No.: US 10,517,341 B2
(45) Date of Patent: Dec. 31, 2019

(54) CONCEALED GUN BELT, HOLSTER AND MAGAZINE HOLDERS

(71) Applicant: S & S Precision, LLC, Virginia Beach, VA (US)

(72) Inventors: Johnny E. Swan, Virginia Beach, VA (US); Andrew C. Borland, Virginia Beach, VA (US); William-Joseph Basan Elizalde, Virginia Beach, VA (US)

(73) Assignee: S&S Precision, LLC, Virginia Beach, VA (US)

( * ) Notice: Subject to any disclaimer, the term of this patent is extended or adjusted under 35 U.S.C. 154(b) by 618 days.

(21) Appl. No.: 14/881,839

(22) Filed: Oct. 13, 2015

(65) Prior Publication Data

US 2016/0100642 A1 Apr. 14, 2016

Related U.S. Application Data

(60) Provisional application No. 62/063,254, filed on Oct. 13, 2014.

(51) Int. Cl.

| | |
|---|---|
| ***A41F 9/00*** | (2006.01) |
| ***A45F 5/02*** | (2006.01) |
| ***F41C 33/04*** | (2006.01) |

(52) U.S. Cl.

CPC ..... *A41F 9/007* (2013.01); *A45F 5/021* (2013.01); *F41C 33/041* (2013.01); *F41C 33/046* (2013.01); *F41C 33/048* (2013.01); *A41F 9/00* (2013.01); *A45F 2200/0591* (2013.01)

(58) Field of Classification Search

CPC . A41D 1/06; A41D 1/08; A41D 27/20; A41D 1/14; A41D 1/20; A41D 1/22; A41D 2300/33; A41D 2400/38; A41D 7/00; A41D 13/0015; A41D 1/00; A41D 2300/22; A41D 2300/32; A41D 2400/44; A61F 9/007; A45F 5/021; F41C 33/0416

USPC ..... 2/236, 227, 247, 237

See application file for complete search history.

(56) References Cited

U.S. PATENT DOCUMENTS

| | | | | | |
|---|---|---|---|---|---|
| 698,198 | A | * | 4/1902 | Hill | |
| 1,506,255 | A | * | 8/1924 | Rosenstein | A41F 9/025 2/236 |
| 1,584,765 | A | * | 5/1926 | Gillette | A41F 9/00 2/229 |
| 1,930,049 | A | * | 10/1933 | Heller | A41F 9/02 2/236 |
| 2,778,026 | A | * | 1/1957 | Rosenthal | A41D 27/20 2/227 |
| 2,810,132 | A | * | 10/1957 | Nicholson | A41D 13/0012 2/247 |

(Continued)

*Primary Examiner* — Alissa J Tompkins
*Assistant Examiner* — Catherine M Ferreira
(74) *Attorney, Agent, or Firm* — Tanner IP, PLLC

(57) ABSTRACT

Holster systems useable with pants including a plurality of outer belt loops and a plurality of inner belt openings around a waist portion of the pants are described. The inner belt openings may be disposed at a first spacing around the waist portion. A holster or holder may also be provided including an opening configured to at least partially receive a firearm, preferably a handgun, and a plurality of slots configured to receive a strap of webbing or similar material therethrough. The slots may be spaced apart from one other at approximately the same distance as the first spacing.

23 Claims, 13 Drawing Sheets

(56) References Cited

U.S. PATENT DOCUMENTS

| | | | | |
|---|---|---|---|---|
| 4,428,080 | A * | 1/1984 | Takamatsu | A41D 1/06 2/227 |
| 4,860,388 | A * | 8/1989 | Dean | A41D 13/012 2/106 |
| 6,283,351 | B1 * | 9/2001 | Brite | F41C 33/0227 224/238 |

* cited by examiner

CONCEALED GUN BELT, HOLSTER AND MAGAZINE HOLDERS

CROSS-REFERENCE TO RELATED APPLICATIONS

This application claims priority under 37 CFR § 1.78(a) to U.S. Provisional Application 62/063,254, filed Oct. 13, 2014 and titled "CONCEALED GUN BELT, HOLSTER AND MAGAZINE HOLDERS," the contents of which are hereby incorporated by reference in their entirety.

BACKGROUND

Police and military personnel typically employ a variety of tactical gear to hold weapons, magazines, and other equipment on their person when not in active use. However, these types of holsters, pouches, etc., are usually not well suited for the concealed carry of such equipment. In today's environment, the needs of protective service details, undercover law enforcement and intelligence personnel, as well as private citizens, call for more effective means of carrying weapons, magazines, and other equipment in unobtrusive, yet accessible, ways.

SUMMARY OF INVENTION

The present invention generally relates to clothing and holsters that are adapted for improving the wearer's ability to secure a firearm, such as a pistol, and weapon magazines on their person, without the need for load bearing equipment or external holsters.

According to first aspects of the invention, pants (trousers, shorts, etc.) may be provided including one or more of outer belt loops around a waist portion of the pants; front pockets; back pockets; inner belt openings around the waist portion of the pants; an inner pocket within at least one of the front pockets; and/or a hidden pocket that has an opening along a seam disposed between at least some of the outer belt loops and the openings of front and/or back pockets.

In embodiments, the inner pocket may be sized and configured to hold at least one of a smart phone, or a folding knife with a blade length over 3 inches. For examples, the inner pocket may have a width of about 3-4 inches and a depth of about 4-6 inches. In embodiments, each inner pocket may have a width of approximately 3 inches, and a depth of approximately 5.5 inches.

In embodiments, each inner pocket may have a top opening that starts about 1 inch below the opening of the front pocket.

In embodiments, the inner belt openings may provide access to a concealed belt slot that runs at least partially around the waist portion of the pants.

In embodiments, the inner belt openings may be spaced approximately equally around the waist portion of the pants, or they may be arranged in pairs that are disposed around the waist portion of the pants.

In embodiments, the inner belt openings may be cut in a piece of material that extends at least partially around the waist portion, and/or formed between pieces of fabric that extend at least partially around the waist portion.

In embodiments, a securing mechanism may be disposed in the belt slot, including, for example, a stiffener, at least two unlike materials inside of the belt slot that provide a non-slip surface, etc.

In embodiments, the opening of the hidden pocket may be between one or more bar tacks, or other reinforced attachments, of the seam, and/or may include a stiffening or friction-enhancing material therein.

In embodiments, the hidden pocket has a width of approximately 2-5 inches and a depth of approximately 5-8 inches.

Embodiments may include a belt, retaining strap, or other elongated element woven through at least some of the belt openings and at least partially disposed in the belt slot.

According to further aspects of the invention, methods of manufacturing pants may include one or more steps of attaching outer belt loops around a waist portion of the pants; providing front pockets; providing back pockets; providing a plurality of inner belt openings around the waist portion of the pants; providing an inner pocket within at least one of the front pockets; and/or providing at least one hidden pocket that has an opening along a seam disposed between at least some of the outer belt loops and the openings of the front and/or back pockets.

In embodiments, the inner pocket may be sized and configured to hold at least one of a smart phone, a folding knife with a blade length over 3 inches, or similar accessory.

In embodiments, each inner pocket may have a top opening that starts about 1 inch below the opening of the front pocket. In embodiments, each inner pocket may have a width of approximately 2-4 inches, preferably about 3 inches, and a depth of approximately 4-6 inches, preferably about 5.5 inches.

In embodiments, the inner belt openings may provide access to a concealed belt slot that runs at least partially around the waist portion of the pants.

In embodiments, the inner belt openings may be spaced approximately equally around the waist portion of the pants, or they may be arranged in pairs that are disposed around the waist portion of the pants.

In embodiments, the inner belt openings may be out in a piece of material that extends at least partially around the waist portion, and/or formed between pieces of fabric that extend at least partially around the waist portion.

Embodiments may include disposing a belt retention mechanism in the belt slot, the belt retention mechanism including, for example, a stiffener, sewn-in hooking material, reinforcements and/or injection molded hooking features.

In embodiments, the opening of the hidden pocket may be between one or more bar tacks, or other reinforced attachments, of the seam.

In embodiments, the hidden pocket has a width of approximately 2-5 inches and a depth of approximately 5-8 inches.

Embodiments may include inserting a belt, retaining strap or other elongated member through at least some of the inner openings and into at least part of the belt slot.

In embodiments, the belt, retaining strap or other elongated member may comprise a length of select materials that prevent slipping and enhance holster stabilization, such as BioThane®, nylon, etc.

According to further aspects of the invention, a holster system may include a holder with an opening configured to at least partially receive a firearm, preferably a handgun, and a plurality of slots configured to receive a strap of webbing or similar material therethrough. In embodiments, the holder may be a substantially monolithic piece of material (e.g. thermoplastic elastomer) that is at least one of molded, machined, cast, or 3-D patterned, in embodiments, the outer surface of the holder may be substantially symmetrical about the middle axis.

In embodiments, the outer surface of the holder may be relatively smooth, and devoid of attachment mechanisms such as loops, hooks, etc.

In embodiments, the plurality of slots may include a front slot that is forward of the opening, a back slot that is rearward of the opening, and at least one tilt slot that extends at least partially below, and at a different angle than, at least one of the front slot or the back slot.

In embodiments, the front slot and the second slot may be spaced apart a first distance that is approximately the same as a spacing between belt openings on a pair of pants.

According to further aspects of the invention, a holster system may include pants including a plurality of outer belt loops and a plurality of inner belt openings around a waist portion of the pants, the inner belt openings disposed at a first spacing around the waist portion; and a holster including an opening configured to at least partially receive a firearm, preferably a handgun; and a plurality of slots configured to receive a strap of webbing or similar material therethrough, the slots spaced apart from one other at approximately the same distance as the first spacing.

In embodiments, a plurality of different holsters may be provided; each of the plurality of holsters configured to receive a differently sized handgun, and having the same slot spacing.

Embodiments may also include an elongated member including a strap portion and a pair of extensions that are attached to the strap portion and that are configured to hold the elongated member in a position along the waist portion of the pants via engagement with the inner belt openings.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention claimed. The detailed description and the specific examples, however, indicate only preferred embodiments of the invention. Various changes and modifications within the spirit and scope of the invention will become apparent to those skilled in the art from this detailed description.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the related technology. No attempt is made to show structural details of technology in more detail than may be necessary for a fundamental understanding of the invention and various ways in which it may be practiced. In the drawings.

DETAILED DESCRIPTION OF THE INVENTION

Figure 1:
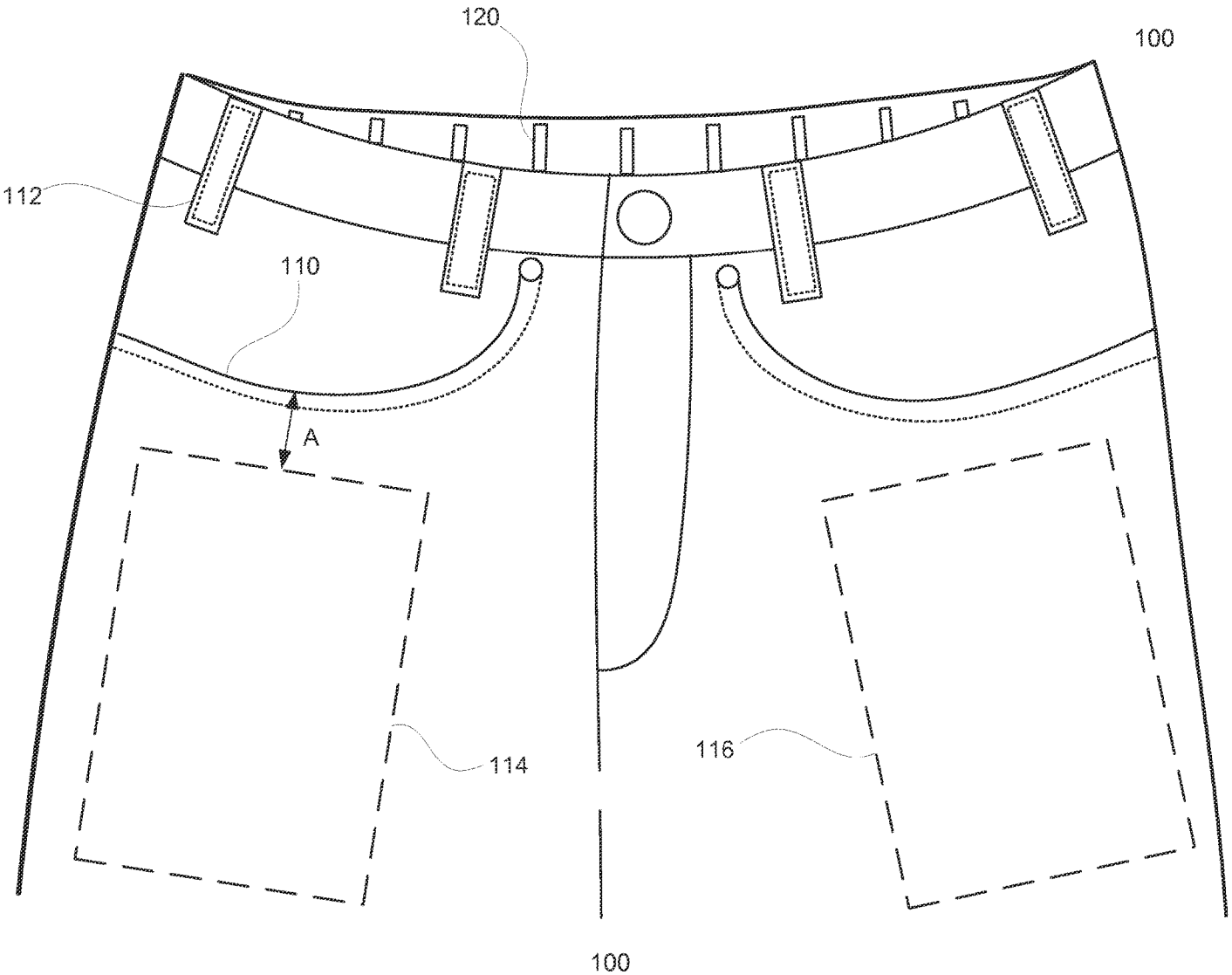
FIG. 1 is a partial front view of an exemplary pair of pants according to aspects of the invention.

It is understood that the invention is not limited to the particular methodology, protocols, etc., described herein, as these may vary as the skilled artisan will recognize. It is also to be understood that the terminology used herein is used for the purpose of describing particular embodiments only, and is not intended to limit the scope of the invention. It also is to be noted that as used herein and in the appended claims, the singular forms "a," "an," and "the" include the plural reference unless the context clearly dictates otherwise. Thus, for example, a reference to "a belt loop" is a reference to one or more belt loops and equivalents thereof known to those skilled in the art.

Unless defined otherwise, all technical terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

Figure 2:
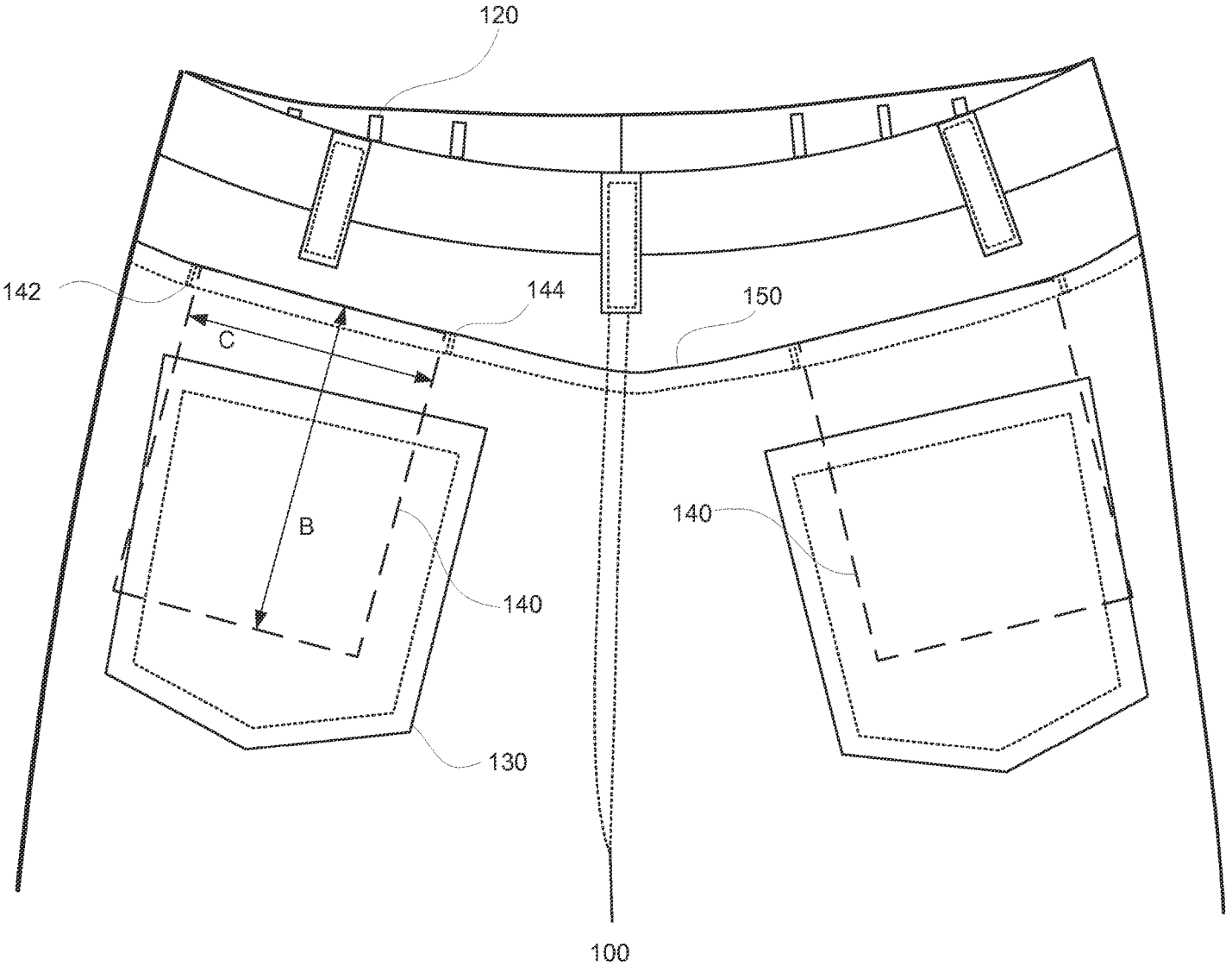
FIG. 2 is a partial rear view of an exemplary pair of pants according to aspects of the invention.

FIGS. 1 and 2 show front and rear views (respectively) of an exemplary waist area of pants 100 (trousers, shorts, etc.) according to aspects of the invention. Pants 100 include outer belt loops 112, front pockets 110, back pockets 130, inner belt openings 120, inner pockets 114, 116 within the front pockets 110; and hidden pockets 140. However, various other embodiments of the invention need not include all of these features.

Figure 3A:
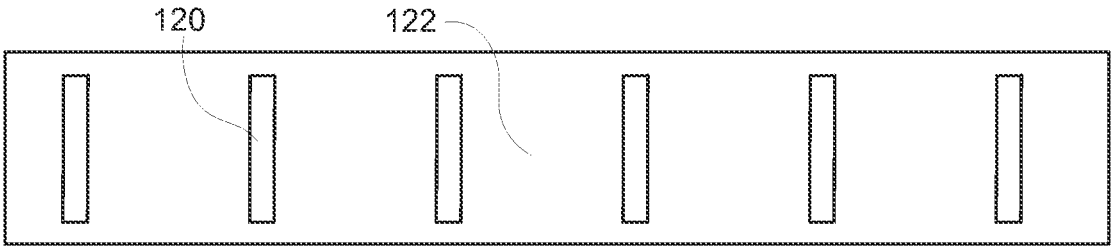
FIGS. 3A-3C depict various inner belt opening arrangements according to aspects of the invention.
Figure 3B:
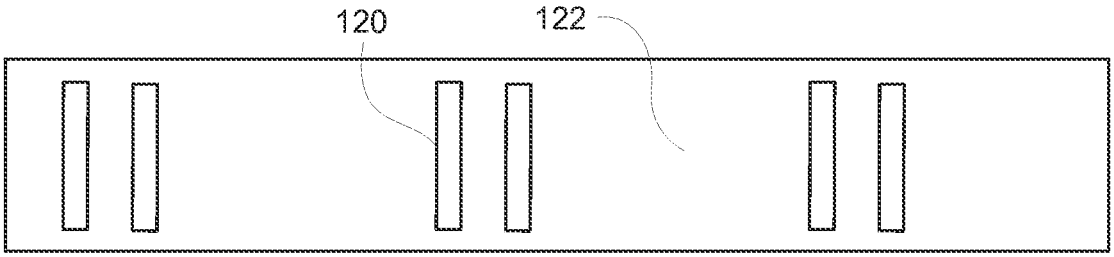

Inner belt openings 120 may allow access to a concealed belt slot (e.g. not open to the outside of the pants) between the inner and outer fabric of the waistband. Inner belt openings 120 may be spaced substantially equally apart, such as shown in FIGS. 1 and 3A, or they may be arranged in pairs (with a larger gap between each pair), such as shown in FIG. 39.

In embodiments, a belt, retaining strap or other elongated member may be disposed at least partially in the concealed belt slot, and may comprise a length of select materials that prevent slipping and enhance holster stabilization, such as BioThane®, nylon, etc.

In embodiments, the concealed belt slot may run substantially throughout, or only partly around the waistband of the pants.

Figure 3C:
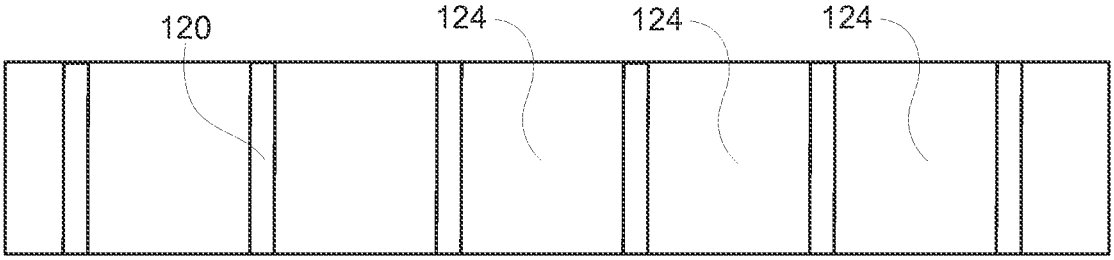

In some embodiments, the inner belt openings 120 may be cut in a piece of material that extends at least partially around the waist portion. In some examples, the "openings" may be formed between, or reinforced by, pieces of fabric that extend at least partially around the waist portion, such as elements 124 shown in FIG. 3C.

Figure 4:
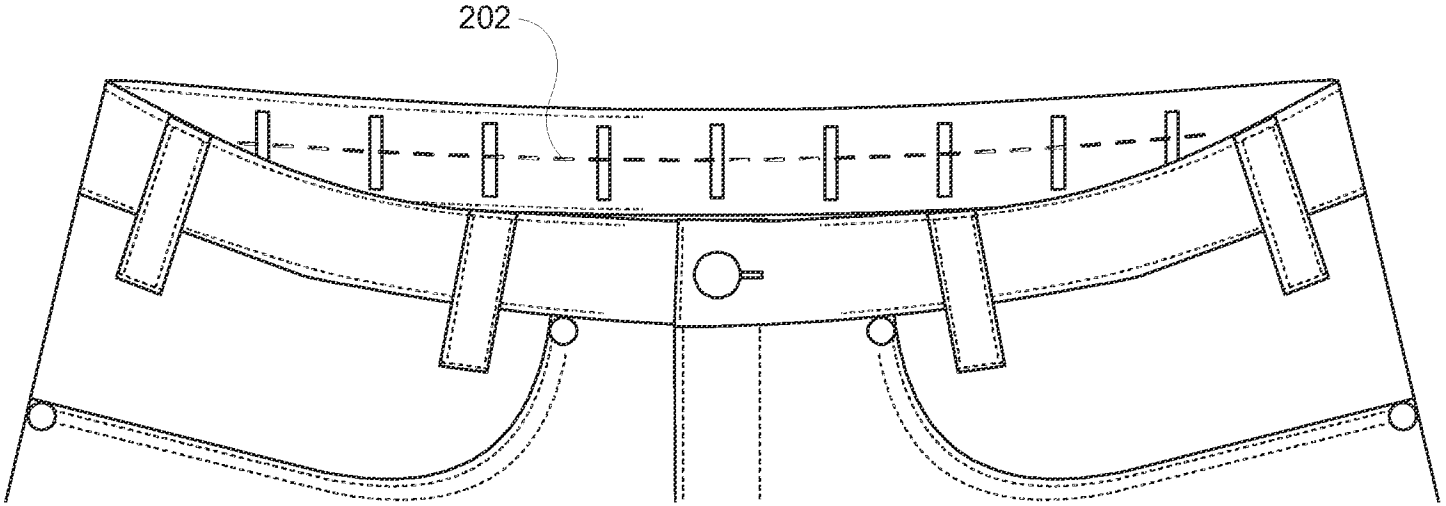
FIG. 4 is a partial front view of an exemplary pair of pants according to aspects of the invention.

In some embodiments, a securing mechanism may be disposed in the belt slot (as generally indicated by the dashed line 202 in FIG. 4), including a stiffener, sewn-in hooking material, reinforcements, and/or injection molded hooking features, etc. The securing mechanism may be configured to prevent a belt or retaining strap disposed in the belt slot from pulling out, e.g. when a holster is secured to the belt.

Figure 5:
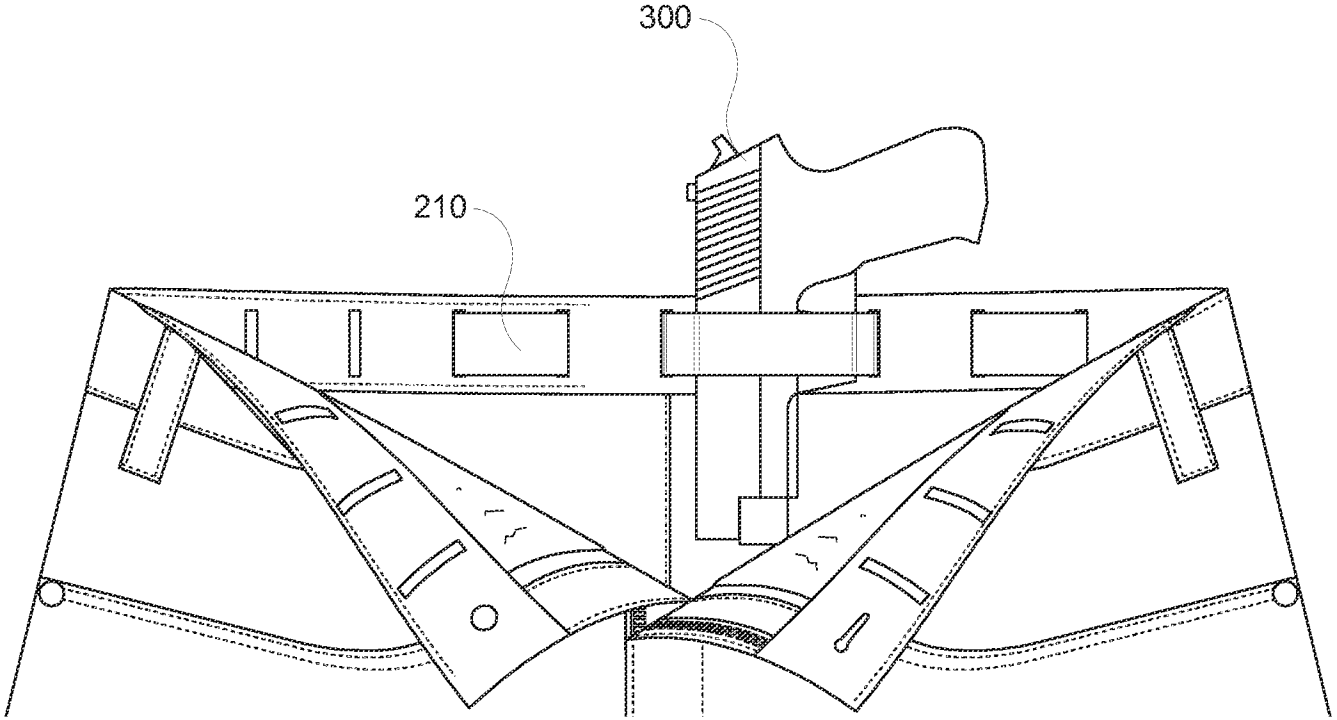
FIG. 5 is a partial front view of an exemplary pair of pants including a partial inner belt holding a handgun according to aspects of the invention.
Figure 6:
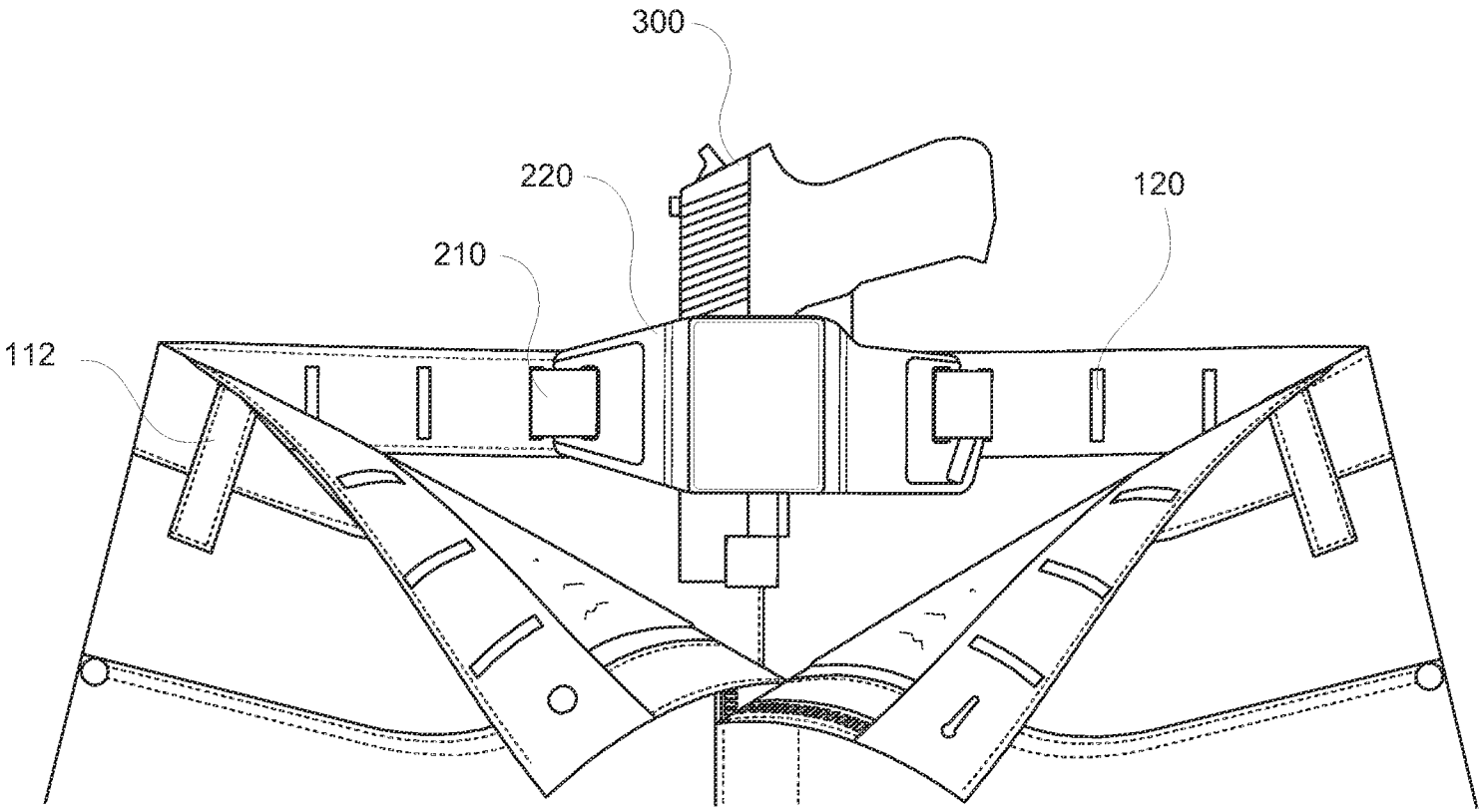
FIG. 6 is a partial front view of an exemplary pair of pants including a partial inner belt holding a handgun holster according to aspects of the invention.

With a belt, retaining strap or other elongated member 210 threaded through the concealed belt slot and the openings, a firearm, such as handgun 300, may be directly secured in the waistband of the pants (e.g. as shown in FIG. 5), or a low-profile holster 220 may be secured by routing the belt/webbing over and/or through attachment points on the holster (such as shown in FIG. 6). It is noted that, although FIG. 6 shows webbing running substantially behind the holster, an alternative arrangement may be to run the webbing substantially over the holster, and back into the concealed belt slot (as described further in FIG. 12).

Figure 7:
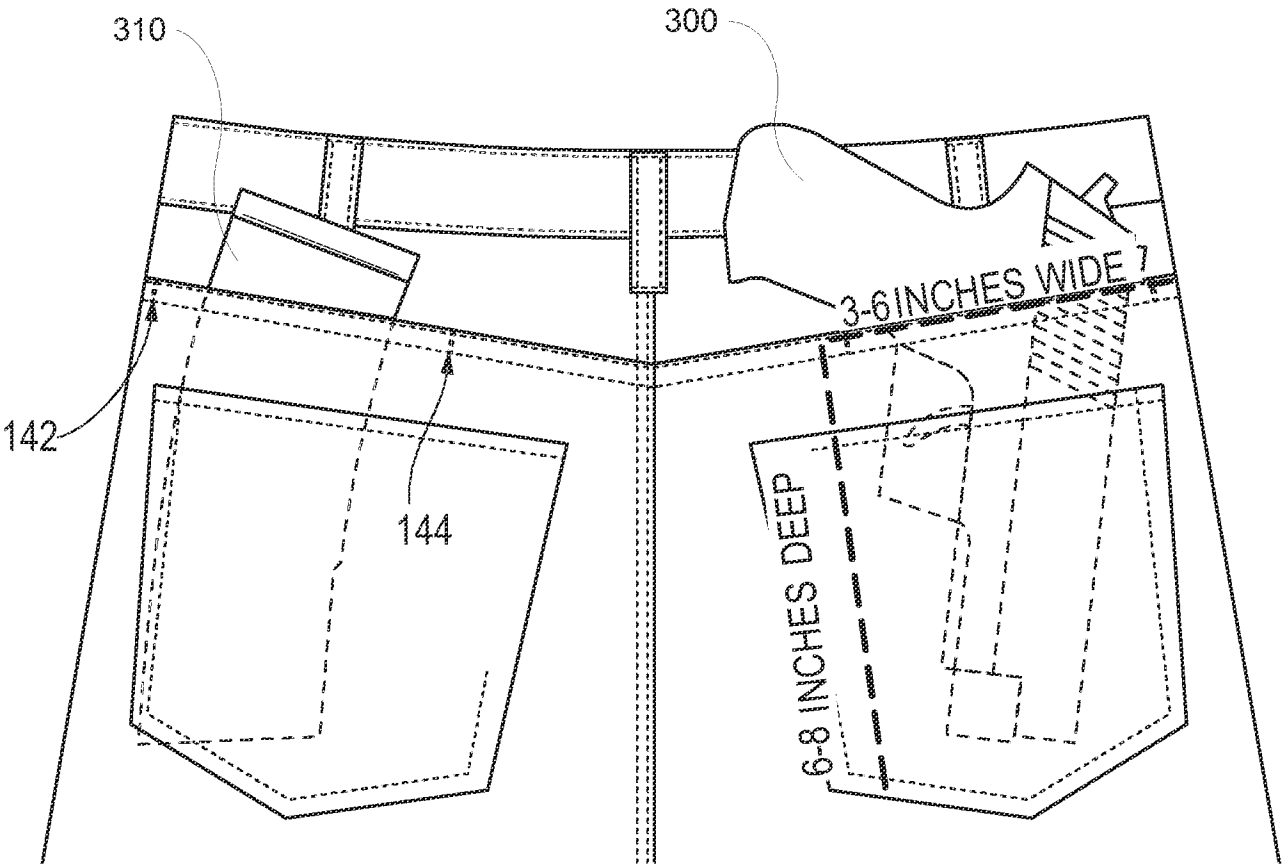
FIG. 7 is a partial rear view of an exemplary pair of pants including hidden pockets according to aspects of the invention.

Returning to FIG. 2, hidden pockets 140 have openings (approximately the width of direction C) along the seam 150, which is disposed between the outer belt loops 112 and the openings of back pockets 130. Placing the opening for the hidden pockets 140 along the seam 150 allows the pockets to be unobtrusive during normal wear, and can allow things like cash or credit cards to be placed in a pocket that is not apparent to casual observation. Hidden pockets 140 may also be sized and configured to hold firearm magazines 310 or the like (such as shown in FIG. 7), and may have width C and depth B sized accordingly. For example, for a 30 round M4 magazine, the width may be about 0.4 inches and the depth may be about 7 inches. Pockets for handgun magazines may be smaller, e.g. around 2 inches×3-5 inches. Multiple hidden pockets may be positioned adjacent to each other, or spaced apart, more or less than shown in FIG. 2. In some examples, the hidden pockets can be sized (larger or smaller) to conceal/store rifle or pistol magazine for quick access. Additionally, the hidden pockets can be sized to retain a full size pistol 300 without the need for a holster (e.g. with the width between 3-6 inches and depth between 6-8 inches).

In embodiments, the opening of the hidden pocket may be between one or more bar tacks 142, 144, or other reinforced attachments, of the seam.

Figure 8:
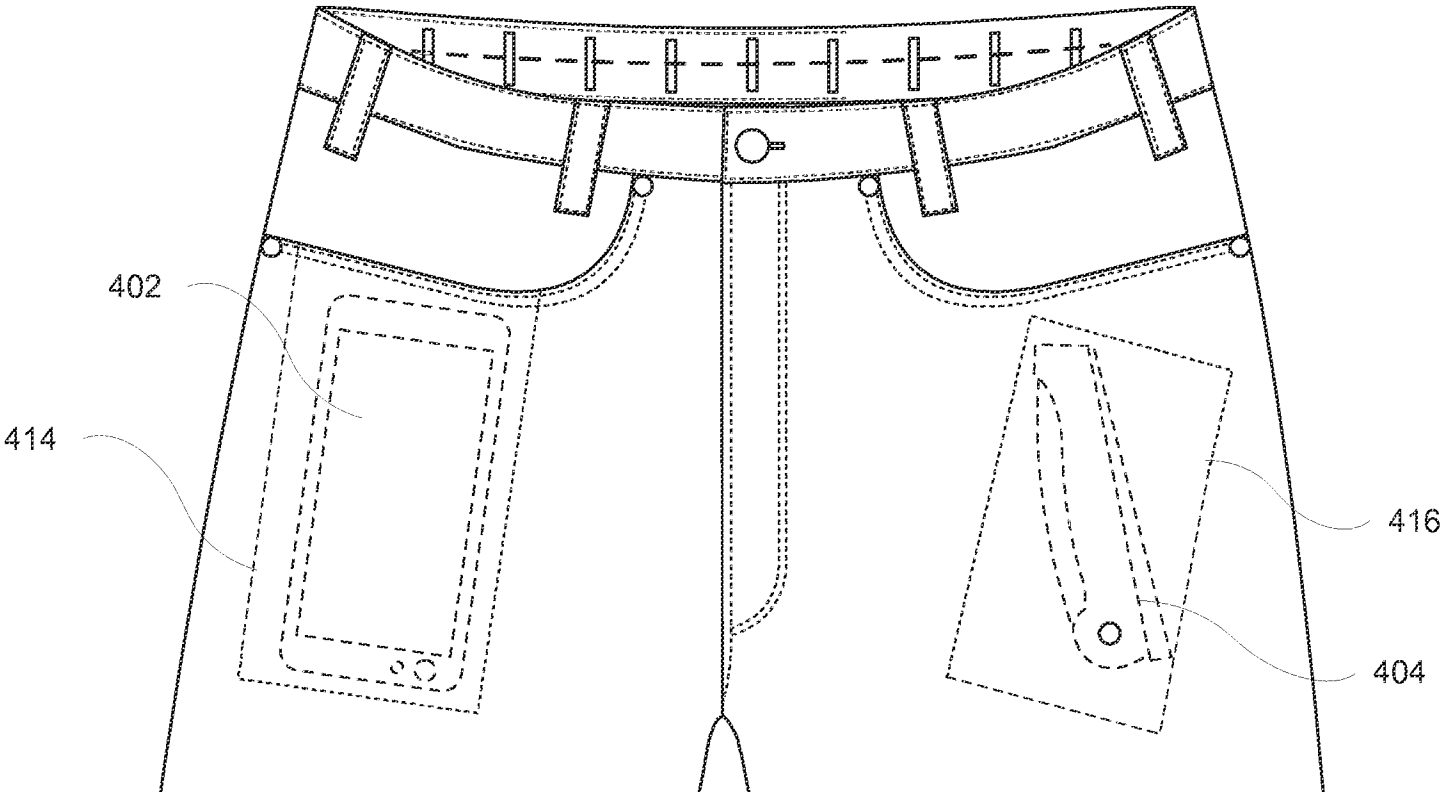
FIG. 8 is a partial front view of an exemplary pair of pants including hidden pockets according to aspects of the invention.

As shown in FIGS. 1 and 8, inner pockets 114, 116, 414 and/or 416 may be sized and configured to hold at least one of a smart phone 402, a folding knife 404 (e.g. with a blade length over 3 inches), or other accessories. In embodiments, each inner pocket may have a top opening that starts about 1 inch below the opening of the front pocket, as shown in FIG. 1. In other examples, the opening may be closer to the actual pocket opening, like inner pocket 414 in FIG. 8. In some examples, the inner pocket may have a different orientation than that of the pocket 110, e.g. the seams and/or opening of the inner pocket may be aligned at different angles than that of the pocket 110, such as generally shown in FIG. 8, inner pocket 416. This can assist, for example, in helping to prevent items in the inner pockets from falling out. In embodiments, each inner pocket may have a width of approximately 2-4 inches, preferably about 3 inches, and a depth of approximately 4-6 inches, preferably about 5.5 inches.

According to further aspects of the invention, methods of manufacturing pants may include assembly of parts such as those described above using techniques as understood by those of skill in the art, and which are not described in unnecessary detail herein.

Figure 9A:
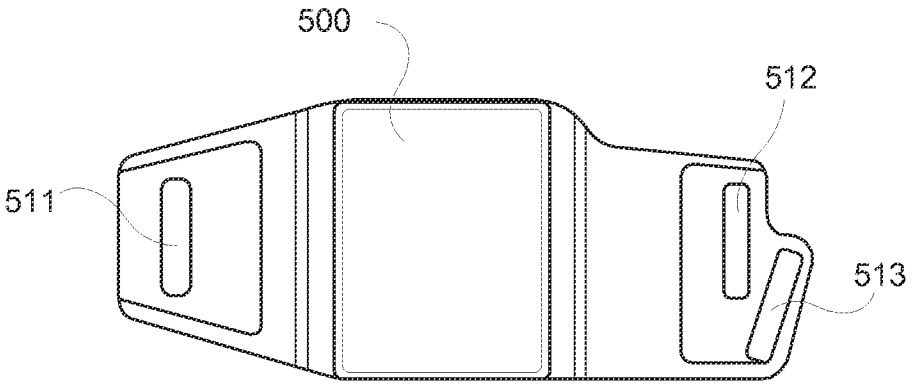
FIGS. 9A-9C depict an exemplary holder according to aspects of the invention.
Figure 9B:
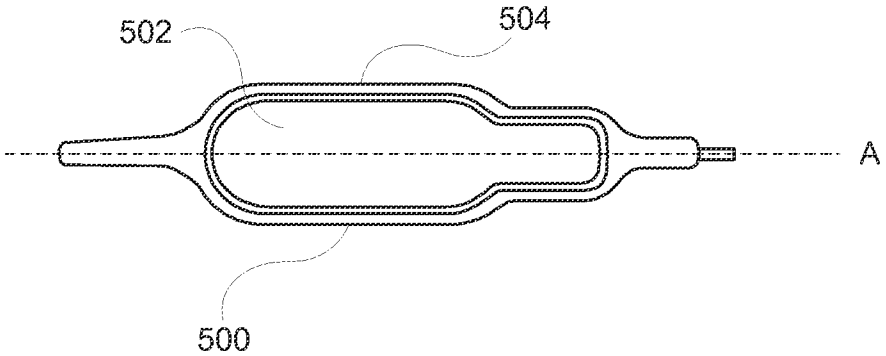
Figure 9C:
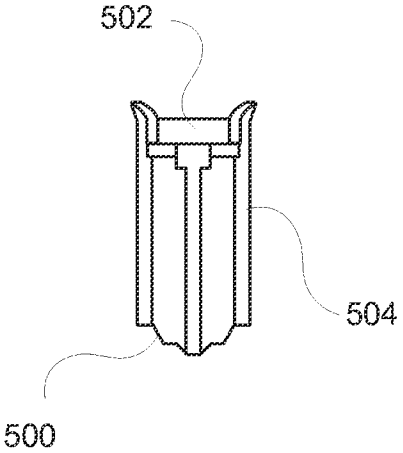

According to further aspects of the invention, a holster system may include a holder 500 like shown in FIGS. 9A-9C. FIG. 9A is a side view. FIG. 9B is a top-down view, and FIG. 9C is a rear view. As best seen in FIG. 9A, holder 500 may include a plurality of slots 511-513 configured to allow a retaining strap or similar material to pass through. As best seen in FIG. 9B, the holder 500 may also include an opening 502 configured to at least partially receive a firearm, preferably a handgun (see also FIG. 6). The holder 500 may be a substantially monolithic piece of thermoplastic elastomer or similar material that is at least one of molded, machined, cast, or 3-D patterned. In embodiments, the outer surface 504 of the holder 500 may be substantially symmetrical about the middle axis (e.g. axis "A" looking down on the holster as shown in FIG. 9B, looking from head on, and/or from behind as shown in FIG. 9C). The holder 500 can be substantially rigid and maintain the matching contours of the opposing surfaces. This can allow the holster to be flipped and used ambidextrously, without changing the surface contour of the holster. In embodiments, the outer surface of the holder 500 may be relatively smooth, and devoid of attachment mechanisms such as loops, hooks, etc. In some instances, the slots 511-513 can be replaced, or supplemented, with surface contours that allow the holster to be secured between the belt and the pants without threading the belt through the pants.

Figure 15A:
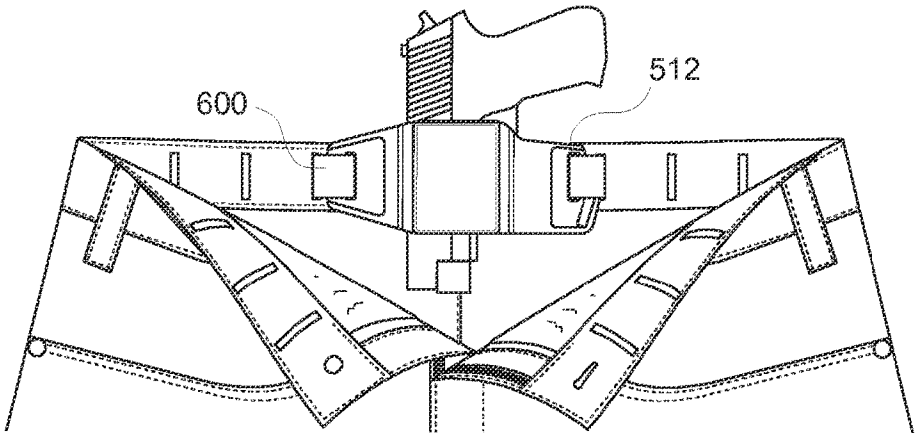
FIGS. 15A-15B are partial front views of an exemplary pair of pants including a partial inner belt holding a handgun holster in different orientations according to aspects of the invention.
Figure 15B:
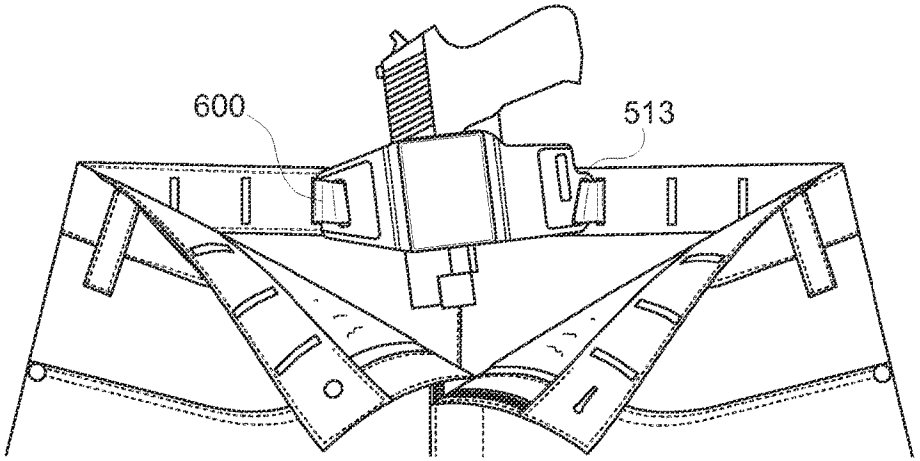

As also shown in FIGS. 9A, 15A and 15B, the plurality of slots may include a front slot 511 that is forward of the opening 502, a back slot 512 that is rearward of the opening 502, and at least one tilt slot 513 that extends at least partially below and/or above, and at a different angle than, at least one of the front slot 511 or the back slot 512. This allows the holster to be mounted at a different angle with respect to the belt, as shown in FIGS. 15A-15B. In some examples, the holster system may include hooks or other attachment means that allow the holster to be secured in alternative ways.

In embodiments, the front slot 511 and the back slot 512 may be spaced apart a first distance that is approximately the same as a spacing between inner belt openings on a pair of pants, such as those described herein.

Although described in the context of a firearm holster, "holders" as described herein may be configured to hold various different items, such as pistol magazines, rifle magazines, radios, flashlights, Tasers, mace or pepper spray, folding or fixed blade knives, or any other piece of equipment that a user may want to secure to their person. In some examples, a holster system may include a holder that is configured to hold a firearm, and one or more other holders configured to hold one or more magazines for the firearm, each of the holders configured (e.g. with appropriately spaced slots) to be secured to similar belt openings using retaining straps that are appropriately sized for the individual holder.

Returning to FIG. 6, a holster system may include pants 100 with a plurality of outer belt loops 110 and a plurality of inner belt openings 120 around a waist portion of the pants, the inner belt openings 120 disposed at a first spacing around the waist portion, and a holster 220 including an opening configured to at least partially receive a firearm, such as handgun 300, and a plurality of slots (such as shown in FIG. 9A) configured to receive a retaining strap 210 therethrough. The slots on the holder 220 may be spaced apart from one other at approximately the same distance as the first spacing, or at a multiple of the first spacing. For example, in the embodiment shown in FIG. 6, the slots of the holder 220 are spaced apart at a distance that is approximately 4 times the distance between each of the inner belt openings 120, allowing fine adjustment of the location of holder 220 around the waistband. In embodiments, a plurality of different holders 220 may be provided, each of which may be configured to receive a differently sized handgun but have the same slot spacing.

Figure 10A:
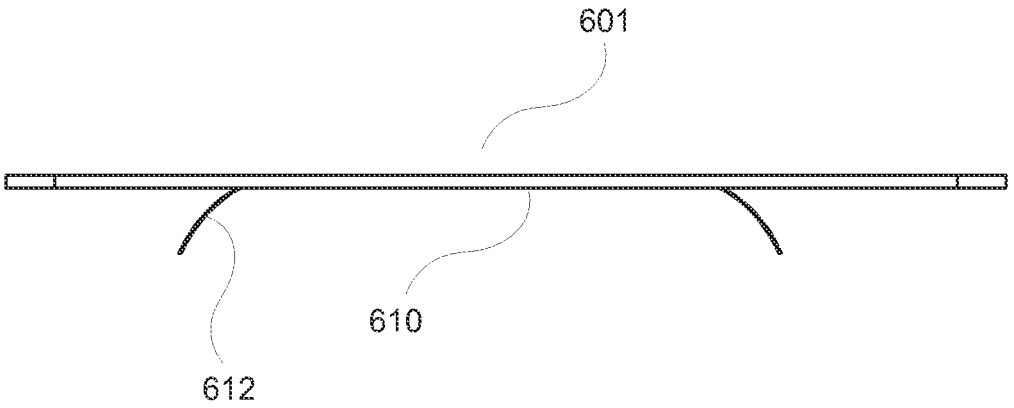
FIGS. 10A-10B depict exemplary retaining straps according to aspects of the invention.
Figure 10B:
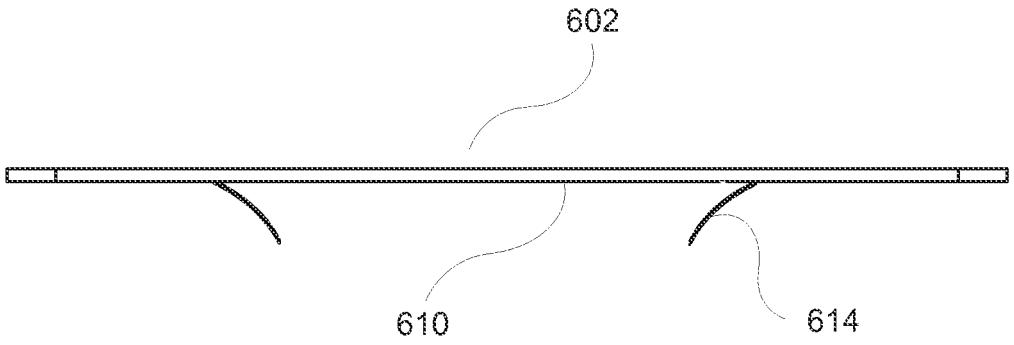

FIGS. 10A and 10B show additional details of exemplary retaining straps. As shown in FIG. 10A, a retaining strap 601 may include a strap portion 610, and retaining elements 612. In some examples, the strap portion and the retaining elements may be made from different materials, may have different thicknesses, or may be configured to have different flexibility. For example, the retaining elements 612 may be made from plastic, and the strap portion 610 may be made from nylon webbing. In the example retaining strap 601 shown in FIG. 10A, the retaining elements 612 have free ends that are biased toward the ends of the retaining strap 601. This may be achieved, for example, by attaching one or more pieces of retaining element material to the strap portion 610. In the example retaining strap 602 shown in FIG. 10B the retaining elements 614 have free ends that are biased toward the middle of the retaining strap 602.

Figure 11:
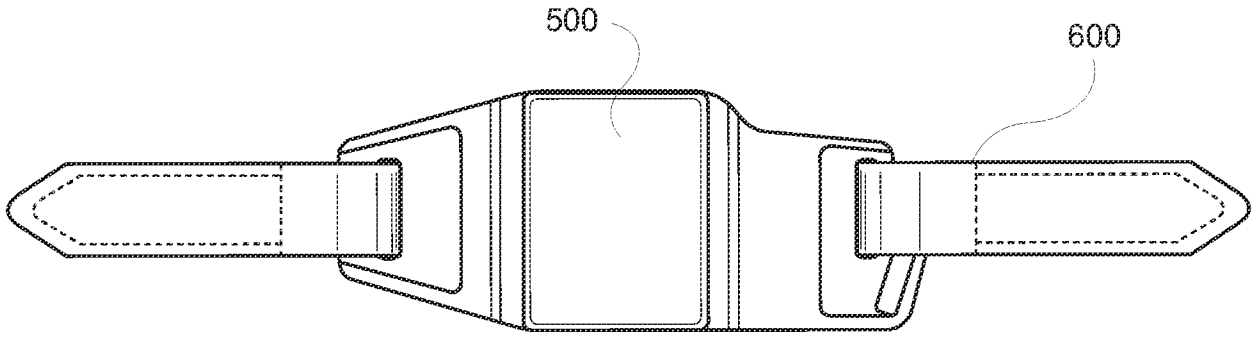
FIG. 11 is a side view of an exemplary holster and retaining strap according to aspects of the invention.
Figure 12:
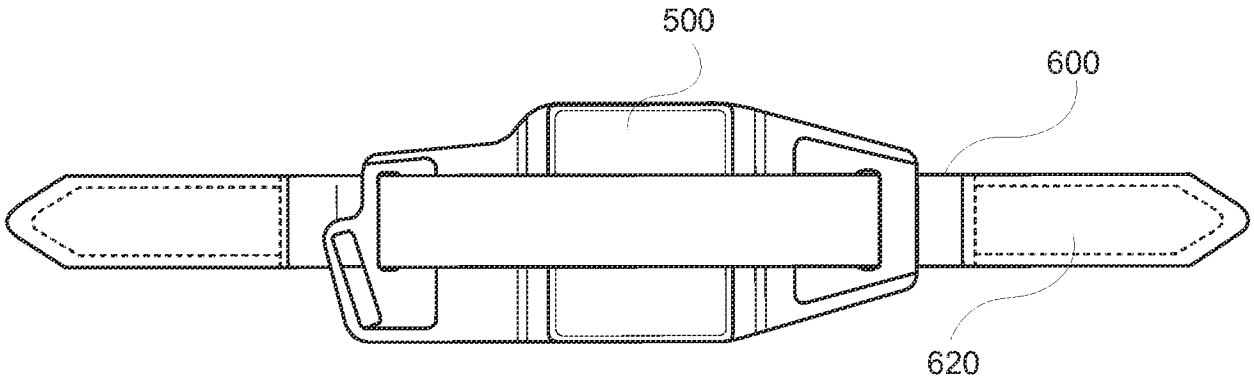
FIG. 12 is a side vie of an exemplary holster and retaining strap according to aspects of the invention.

As further shown in FIGS. 11 and 12, a retaining strap 600 may be relatively small compared to a complete waist belt, e.g. about 1.5-3×the length of the holder 500, or 8-12 inches long. The retaining strap 600 may include a short length of different material (e.g., at 620 or other part of the strap portion 610 or retaining elements 612, 614) that prevents slipping and lance holster stabilization, such as BioThane®, nylon, etc. The retaining strap can be routed substantially behind (as in FIG. 11) or in front (as in FIG. 12) of the holder 200, and can allow the holder 200 to be secured to the waist belt in either left or right orientation.

Figure 13:
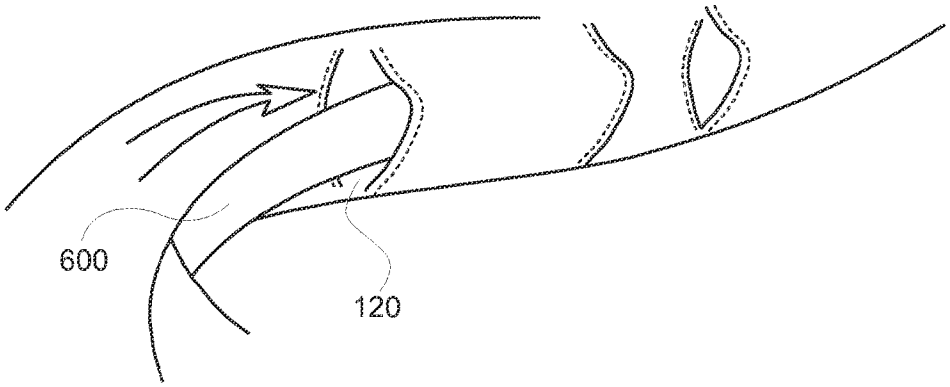
FIGS. 13 and 14 depict aspects of an exemplary retaining strap being inserted into retaining slots according to aspects of the invention.
Figure 14:
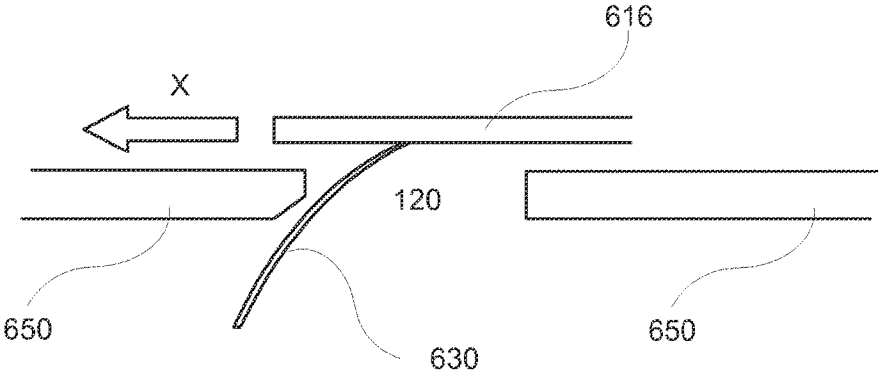

As further shown in FIGS. 13 and 14, a retaining strap 600 may be inserted into inner belt openings 120 (see FIG. 13) and prevented from pulling back out via retaining elements 616. FIG. 14 shows one side of an example in which a strap portion 630 extends away from retaining element 616 and the junction of retaining element 616 and strap portion 630 engages with the inner waistband fabric (or other reinforcing material) 650 to prevent the retaining strap from withdrawing from the concealed belt slot. In this example, the strap portion could extend around a holder (like 500), and enter another inner belt opening 120 (not shown) with a similar engagement mechanism, which would position the holder 500 along the waistband without allowing the retaining strap 600 to pull out of the concealed belt slot while the pants are worn via tension in direction "X." With the pants removed, tension on the retaining strap 600 may be released, and the retaining strap 600 extracted from the concealed belt slot by pushing the retaining element 616 opposite direction "X" until the junction is no longer engaged with the fabric 650.

In some examples, the retaining strap shown in FIGS. 11-14 may include a pair of strap portions that are configured to be inserted in the belt slot, and a middle portion attached to each of the strap portions and configured to engage with a holster. The middle portion may be attached to the strap portions at positions such that each of the strap portions, or a stiffener attached to the strap portions, extend beyond the attachment positions.

FIGS. 15A and 15B show how a holder 500 may be positioned at different angles by routing the retaining strap 600 through different slots. In FIG. 15A, the retaining strap 600 is routed through a back slot 512, resulting in a "flat" angle with the opening 502 substantially parallel with the waistband of the pants. In FIG. 15B, the retaining strap 600 is routed through another slot 513, resulting in the opening 502 being non-parallel with the waistband of the pants.

Although described in the context of a concealed belt slot, the retaining strap and holder configurations described herein may also be applied in various other contexts, such as attaching the holder to other tactical equipment or clothing with similar openings that the retaining strap may engage with.

While various embodiments have been described above, it is to be understood that the examples and embodiments described above are for illustrative purposes only and that various modifications or changes in light thereof will be suggested to persons skilled in the art, and are to be included within the spirit and purview of this application and scope of the appended claims. Therefore, the above description should not be understood as limiting the scope of the invention as defined by the claims.

What claimed is:

1. Pants, comprising:

a plurality of outer belt loops around a waist portion of the pants;

a plurality of front pockets;

a plurality of back pockets;

a plurality of inner belt openings around the waist portion of the pants, the inner belt openings providing access to a concealed belt slot that is at least partially around the waist portion of the pants;

a retaining strap configured to be passed through at least some of the inner belt openings and into at least part of the concealed belt slot; and at least one of:

an inner pocket within at least one of the front pockets, the inner pocket having a width of approximately 3-4 inches and a depth of approximately 4-6 inches; and a hidden pocket that has an opening along a seam disposed between at least some of the outer belt loops and an opening of at least one of the front and back pockets, wherein the hidden pocket has a width of approximately 2-5 inches and a depth of approximately 5-8 inches, wherein, the retaining strap has a length of approximately 8-12 inches, and includes a pair of strap portions at opposite ends of the retaining strap that are configured to be inserted at least partially in the concealed belt slot, and a middle portion disposed between the strap portions and configured to be woven through an accessory holder, and the strap portions each include a retaining element that extends from the respective strap portion, each of the retaining elements forming a notch configured to engage with one of the inner belt openings when the respective strap portion is inserted in the concealed belt slot and thereby prevent the respective strap portion from being withdrawn from the concealed belt slot.

2. The pants of claim 1 wherein the inner belt openings are spaced equally around the waist portion of the pants.

3. The pants of claim 1, wherein the inner belt openings are arranged in pairs that are disposed around the waist portion of the pants.

4. The pants of claim 1, wherein the concealed belt slot includes closed portions between the inner belt openings that are disposed between an inner fabric of the waistband and an outer fabric of the waistband, and the inner belt openings are at least one of cut in a piece of material that extends at least partially around the waist portion, or formed between pieces of fabric that extend at least partially around the waist portion.

5. The pants of claim 1, comprising the inner pocket, wherein each inner pocket has a top opening that starts about 1 inch below the opening of the front pocket.

6. The pants of claim 1, comprising the inner pocket, wherein each inner pocket has a width of approximately 3 inches, and a depth of approximately 5.5 inches.

7. The pants of claim 1, comprising the hidden pocket, wherein the opening of the hidden pocket is between one or more bar tacks, or other reinforced attachments, of the seam.

8. The pants of claim 1, further comprising a securing mechanism disposed in the concealed belt slot, including a first material inside of the concealed belt slot that is configured to engage with a second material included on a portion of the retaining strap configured to be inserted in the concealed belt slot.

9. The pants of claim 1, wherein the retaining strap comprises a length of stiffening material that is configured to enhance stabilization of the accessory holder.

10. The pants of claim 1, wherein the middle portion is configured to engage with a holster.

11. The pants of claim 1, further comprising a belt retention mechanism in the concealed belt slot, the belt retention mechanism including at least one of sewn-in hook material or sewn-in loop material.

12. The pants of claim 1, further comprising:

the accessory holder, the accessory holder having an opening configured to at least partially receive a piece of tactical equipment, and a plurality of slots configured to receive at least part of the retaining strap therethrough, wherein the accessory holder is a monolithic piece of thermoplastic elastomer that is at least one of molded, machined, cast, or 3-D patterned, and the outer surface of the accessory holder is substantially symmetric about the middle axis.

13. Pants, comprising:

a plurality of outer belt loops around a waist portion of the pants;

a plurality of front pockets;

a plurality of back pockets;

a plurality of inner belt openings around the waist portion of the pants, the inner belt openings providing access to a concealed belt slot that is at least partially around the waist portion of the pants;

a retaining strap configured to be passed through at least some of the inner belt openings and into at least part of the concealed belt slot; and a holder with an opening configured to at least partially receive a firearm, and a plurality of slots configured to receive at least part of the retaining strap therethrough, wherein the holder is a monolithic piece of thermoplastic elastomer that is at least one of molded, machined, cast, or 3-D patterned, the outer surface of the holder is substantially symmetric about the middle axis, and the plurality of slots include a front slot that is forward of the opening, a back slot that is parallel to the front slot and rearward of the opening, and at least one tilt slot that extends below at least one of the front slot or the back slot, and the tilt slot is disposed at a different angle than the front slot and the back slot so that the tilt slot is non-parallel to the front slot and the back slot.

14. The pants of claim 13, wherein the front slot and the back slot are spaced apart a first distance that is approximately the same as a spacing between the inner belt openings on the pants.

15. The pants of claim 13, wherein the retaining strap is configured to resist withdrawal back through the inner belt opening.

16. The pants of claim 1, wherein the inner belt openings are disposed at a first spacing around the waist portion, the pants further comprising:

a holster including an opening configured to at least partially receive a firearm, and a plurality of slots configured to receive a strap therethrough, wherein the slots are spaced apart from one other at approximately the same distance as the first spacing.

17. The pants of claim 16, further comprising a plurality of holsters, each of the plurality of holsters configured to receive a differently sized handgun, and having the same slot spacing.

18. Pants, comprising:

a plurality of outer belt loops around a waist portion of the pants;

a plurality of front pockets;

a plurality of back pockets;

a plurality of inner belt openings around the waist portion of the pants, the inner belt openings providing access to a concealed belt slot that is at least partially around the waist portion of the pants;

a retaining strap configured to be passed through at least some of the inner belt openings and into at least part of the concealed belt slot; and a holder with an opening configured to at least partially receive a piece of equipment, and a plurality of holder slots configured to receive the retaining strap therethrough, wherein, the retaining strap has a length of approximately 8-12 inches, and includes a pair of strap portions at opposite ends of the retaining strap that are configured to be inserted at least partially in the concealed belt slot, and a middle portion attached to each of the strap portions and configured to engage with the holder via the holder slots, and the strap portions each include a retaining element that extend from the respective strap portion, each of the retaining elements forming a notch configured to engage with one of the inner belt openings when the respective strap portion is inserted in the concealed belt slot and prevent the respective strap portion from being withdrawn from the concealed belt slot.

19. The pants of claim 18, wherein the piece of equipment is at least one of a firearm, a pistol magazine, a rifle magazine, a radio, a flashlight, a mace or pepper spray, or a knife.

20. The pants of claim 18, wherein the piece of equipment is a firearm.

21. The pants of claim 18, wherein the piece of equipment is a firearm magazine.

22. The pants of claim 18, wherein the opening is configured to hold a cylindrical piece of equipment.

23. The pants of claim 18, wherein the strap portions and the middle portion of the retaining strap are made of nylon and the retaining elements are made of plastic.

* * * * *